US009085836B2

(12) United States Patent
Schutt et al.

(10) Patent No.: US 9,085,836 B2
(45) Date of Patent: Jul. 21, 2015

(54) DEVICE FOR PRODUCING A FIBER PRODUCT BY LAYING DOWN MELT-SPUN FIBERS

(71) Applicant: Oerlikon Textile GmbH & Co. KG, Remscheid (DE)

(72) Inventors: Gunter Schutt, Neumunster (DE); Bernhard Potratz, Hamburg (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 110 days.

(21) Appl. No.: 14/071,034

(22) Filed: Nov. 4, 2013

(65) Prior Publication Data

US 2014/0057011 A1 Feb. 27, 2014

Related U.S. Application Data

(63) Continuation-in-part of application No. PCT/EP2012/060338, filed on Jun. 1, 2012.

(30) Foreign Application Priority Data

Jun. 9, 2011 (DE) ..... 102011103662

(51) Int. Cl.

| | |
|---|---|
| ***D04H 3/00*** | (2012.01) |
| ***D04H 3/005*** | (2012.01) |
| ***D04H 1/56*** | (2006.01) |
| ***D04H 3/16*** | (2006.01) |

(52) U.S. Cl.

CPC ..... *D04H 3/005* (2013.01); *D04H 1/56* (2013.01); *D04H 3/16* (2013.01)

(58) Field of Classification Search

USPC ..... 425/72.2, 71

See application file for complete search history.

(56) References Cited

U.S. PATENT DOCUMENTS

| | | | |
|---|---|---|---|
| 2002/0086072 | A1 | 7/2002 | Allen et al. |
| 2003/0085493 | A1 | 5/2003 | Allen et al. |
| 2010/0178372 | A1 | 7/2010 | Schutt et al. |
| 2011/0244066 | A1 | 10/2011 | Schütt |

FOREIGN PATENT DOCUMENTS

| | | |
|---|---|---|
| EP | 1 225 263 | 7/2002 |
| EP | 2208811 | 7/2010 |
| WO | WO 2010054943 | 5/2010 |

OTHER PUBLICATIONS

PCT/EP2012/060338 International Search Report dated Nov. 22, 2012 (4 pages including English translation).

PCT/EP2012/060338 International Preliminary Report on Patentability dated Dec. 10, 2013 (6 pages).

*Primary Examiner* — Jacob Thomas Minskey

(74) *Attorney, Agent, or Firm* — Brinks Gilson & Lione; G. Peter Nichols

(57) ABSTRACT

A device is described for producing a fiber product by laying down melt-spun fibers onto a laydown belt. A spinning device is associated with a top side of the laydown belt and a suction-extraction device is associated with the bottom side. A vacuum device has a movable suction chamber which interacts with the spinning device in order to lay down the fibers on the laydown belt. To generate a uniform suction flow in every position of the suction chamber, the suction chamber is formed from a stationary bottom box and a movable top box which are coupled to one another in a pressure-tight manner.

18 Claims, 6 Drawing Sheets

DEVICE FOR PRODUCING A FIBER PRODUCT BY LAYING DOWN MELT-SPUN FIBERS

Figure 1:
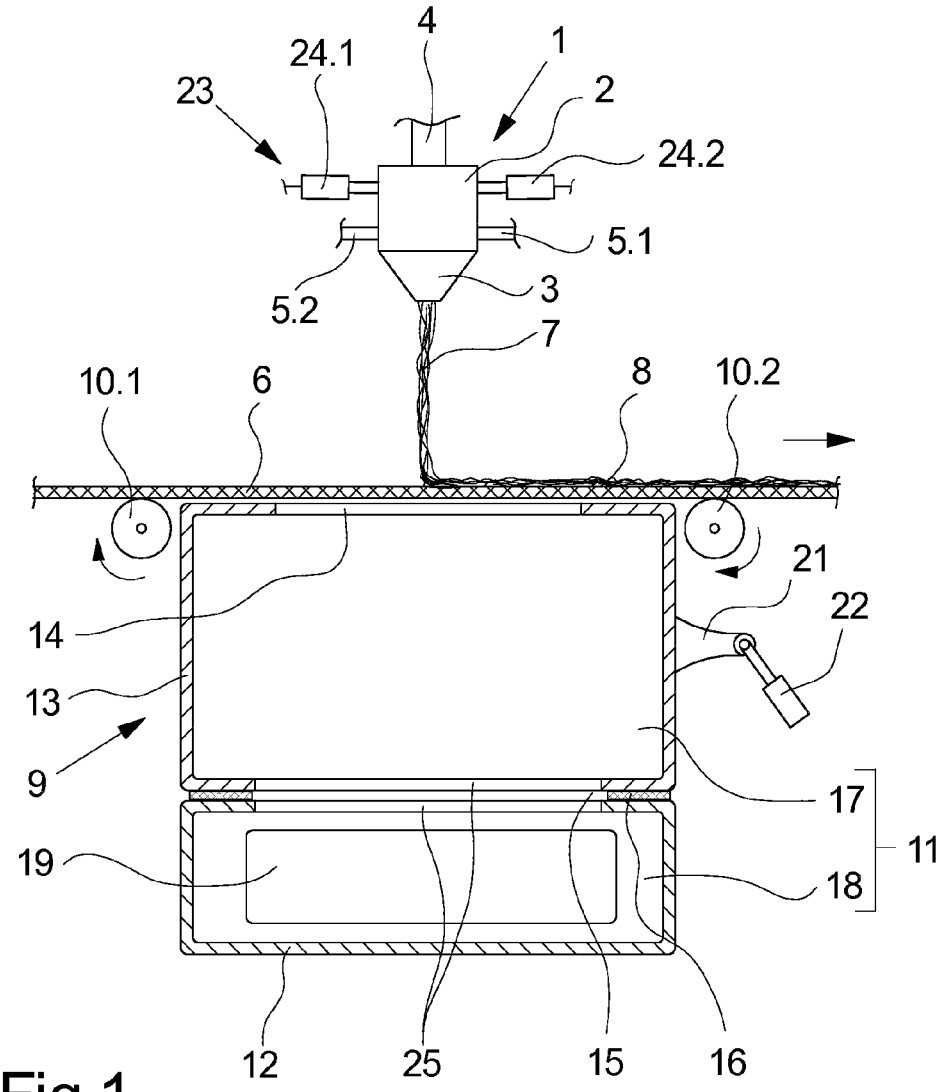

This application is a continuation-in-part of and claims the benefit of priority from PCT application PCT/EP2012/060338 filed Jun. 1, 2012; and German Patent Application 102011103662.1 filed Jun. 9, 2011, the disclosure of each is hereby incorporated by reference in its entirety.

The present invention concerns a device for producing a fiber product by depositing melt-spun fibers on a delivery belt.

A device of this type for producing a fiber product by depositing melt-spun fibers on a delivery belt is known, for example, from WO 2010/054943 A1.

With the depositing of melt-spun fibers on a delivery belt, a vacuum device is provided on the undersurface of the delivery belt for, on one hand, receiving and discharging the blow air generated during the deposit, and on the other hand, to affect the fiber deposit on the upper surface of the delivery belt to form the fiber product. For this, it is necessary that a substantially uniform vacuum is generated on the undersurface of the delivery belt by the vacuum device over the course of a deposit zone so that no irregularities occur in the deposit of the fibers and receiving of the blow air. The known device includes a large volume vacuum chamber, which extends beneath the delivery belt with a chamber opening that runs transverse to the delivery belt. For an individual alignment of, and to adjust, the fiber deposit, the vacuum chamber is designed such that it can be moved beneath the delivery belt, in order to be able to form different vacuum zones in the conveyance direction of the delivery belt. The vacuum chamber is mounted on a carrier having a stationary vacuum attachment. A lower chamber opening of the vacuum chamber is designed such that the vacuum attachment is connected to the vacuum chamber in any position of the vacuum chamber. Thus, it is necessary that the vacuum attachment has a substantially smaller cross-section at its opening than the intake opening of the vacuum chamber. A cross-section narrowing of this type in a vacuum system inevitably leads to an increase in the flow rate, associated with higher pressure losses, such that, depending on the location of the vacuum chamber, different edge effects occur in the vacuum chamber, and in particular in the vacuum opening.

In order to form an extensive deposit zone on the delivery belt, a vacuum device for a delivery belt, for receiving deposited fibers, is known from EP 1 225 263, in which the vacuum device includes three separate vacuum chambers, which are disposed successively in the conveyance direction of the delivery belt. Each of the vacuum chambers forms a chamber opening opposite the delivery belt, such that numerous vacuumed deposit zones are formed on the upper surface of the delivery belt. As a result, it is possible to implement relatively large channel cross-sections on each vacuum chamber, in order to implement the demands for lower air flow rates as well as a relatively small pressure decrease, by means of the vacuum system. This has, however, the disadvantage that individual adjustment of the chamber openings of the vacuum chambers in relation to the delivery belt is not possible.

It is therefore the objective of the invention to further develop a generic device for producing a fiber product by depositing melt-spun fibers on the delivery belt, such that an individual deposit zone having a uniform vacuum can be adjusted.

This objective is attained according to the invention in that the vacuum chamber is formed by a stationary lower box and a moveable upper box, which are coupled to one another in a pressure-tight manner.

The device of the present invention is characterized in that the entire chamber cross-section of the vacuum chamber can be used to guide the vacuum flow, depending on the position of the upper box in relation to the lower box. By creating a separation zone formed between the upper box and the lower box, different positions of the upper box in relation to the lower box can be implemented. A deflection of the vacuum flow is not necessary because the upper box and the lower box are mounted in a vertical configuration beneath the delivery belt.

The device of the present invention can further include a seal for sealing the vacuum chamber. The seal is disposed in a sliding joint between the lower box and the upper box, such that the lower box is connected to a vacuum attachment channel. As a result, pressure losses can be advantageously minimized, such that relatively low vacuums in the range of 50 mbar-200 mbar are possible.

The mobility of the upper box in relation to the delivery belt can also be advantageously used to adjust the width of the deposit zone. The device according to the invention is designed such that the upper box, in relation to the delivery belt, forms a longitudinal chamber opening to the vacuum chamber, which is oriented such that it is transverse to the delivery belt, with which the position of the chamber opening in relation to the delivery belt can be modified by rotating the upper box in relation to the lower box. Thus, an individual width adjustment of the deposit zone on the delivery belt is possible.

In order to further increase the flexibility of the deposit zone, the upper box and the lower box include numerous vacuum chambers, which are disposed successively in the direction of conveyance of the delivery belt, wherein each of the vacuum chambers is associated with one of numerous seals between the upper box and the lower box. By providing additional vacuum chambers, it is possible to incorporate external air from the surroundings in the depositing of the fibers in the deposit zone.

In order that the vacuum power can be individually adjusted in the vacuum chambers, the vacuum chambers in the lower box have more vacuum attachment channels associated with them, wherein the vacuum chambers can be separately connected to one of numerous vacuum blowers. Thus, it is possible, for example, to adjust a greater vacuum for receiving the blow flow and for depositing the fibers in a central chamber, in comparison with the adjacent vacuum chambers, which can be operated with lower vacuums.

The vacuum chambers in the upper box advantageously include numerous chamber openings, which are disposed parallel to one another, and depending on the position of the upper box in relation to the delivery belt, extend in a direction transverse to the delivery belt.

In order to transfer the vacuum flow between the upper box and the lower box, a central vacuum chamber includes a circular shaped transition cross-section in the sliding joint between the two boxes. Two of the outer vacuum chambers adjacent to the central vacuum chamber have a kidney-shaped transition cross section in the sliding joint between the two boxes. In this manner, rotational movements, in particular, of the upper box in relation to the lower box, are possible within a large angular range, without the transitions between the vacuum chamber sections in the lower box and upper box forming cross-sections that are too small.

In order to adjust the width of the deposit zone, the upper box is advantageously designed such that it can be adjusted in relation to the lower box within an angular range of 45°.

The adjustment of the upper box in relation to the lower box advantageously occurs by means of one or more adjustment control actuators, which enable a displacement or rotation of the upper box about a central axis. The upper box and the lower box are typically disposed in a machine frame for this.

With the depositing of fibers, the effect of external air can also be advantageously defined by means of displacing the vacuum device in relation to the spinning device toward the machine. For this, the lower box is designed such that it can be adjusted together with the upper box in the direction of conveyance of the delivery belt.

In order to be able to advantageously obtain a deposit of the fibers with the respective position of the chamber opening of the vacuum chamber in the upper box in relation to the delivery belt, it is provided that the spinning device has a longitudinal spinning beam, which extends in a direction transverse to the delivery belt, and is designed such that it can be pivoted in a plane that is parallel to the delivery belt. Thus, it is possible to guide the spinning beam, parallel to the upper box of the vacuum device, to a corresponding position, such that the depositing and receiving of the fibers can occur substantially in the center of the adjusted chamber opening of the vacuum chamber.

The device according to the invention thus offers a high degree of flexibility for depositing numerous melt-spun fibers on a delivery belt for producing a fiber product. The spinning device can have a conventional melt-blow device, such that the extruded fibers are guided onto the delivery belt by an air flow generated on both sides of the spinneret. The spinning device can include an exhaust nozzle disposed spaced adjacent to the spinneret, which receives the extruded filaments and blows an airflow onto the delivery belt. Fiber products of this type are referred to by persons skilled in the art as spunbond nonwovens. The device according to the invention offers, independently of the depositing methods, a uniform generation of a vacuum flow over the respective deposit zone being used, such that a uniform production of the fiber product is possible over the entire width of the deposit zone.

The device according to the invention shall be explained in greater detail in the following, with reference to the attached figures.

FIG. 1 schematically shows a longitudinal section of a first embodiment of the device according to the invention.

Figure 2:
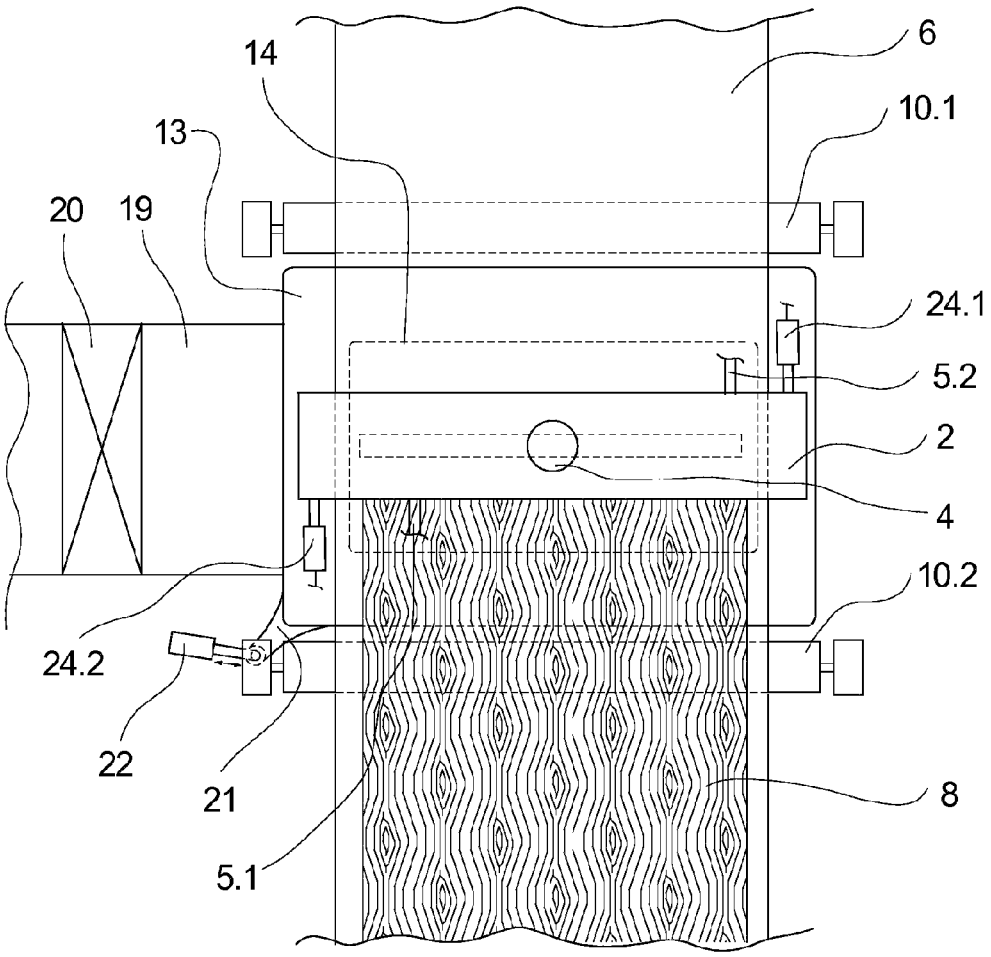

FIG. 2 schematically shows a top view of the embodiment from FIG. 1.

Figure 3:
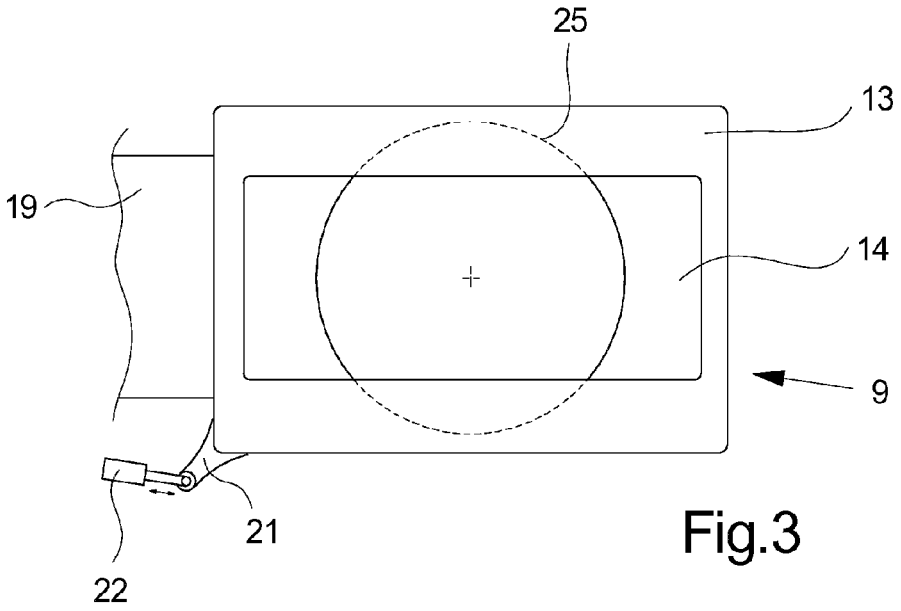

FIG. 3 schematically shows a top view of the vacuum device of the embodiment from FIG. 1, disposed beneath the delivery belt.

Figure 4:
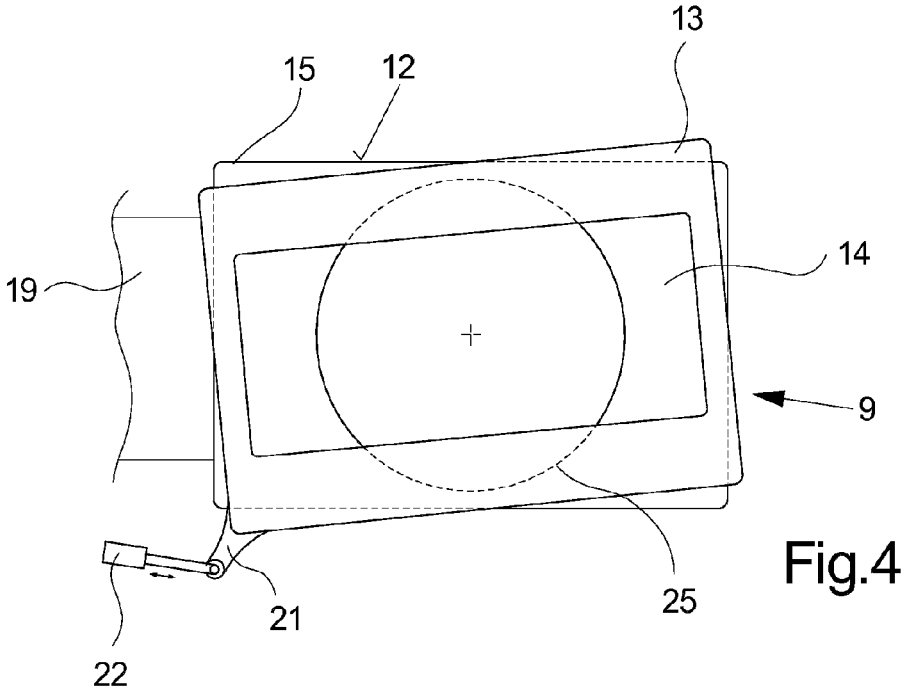

FIG. 4 schematically shows a top view of the embodiment from FIG. 3, in a different position.

Figure 5:
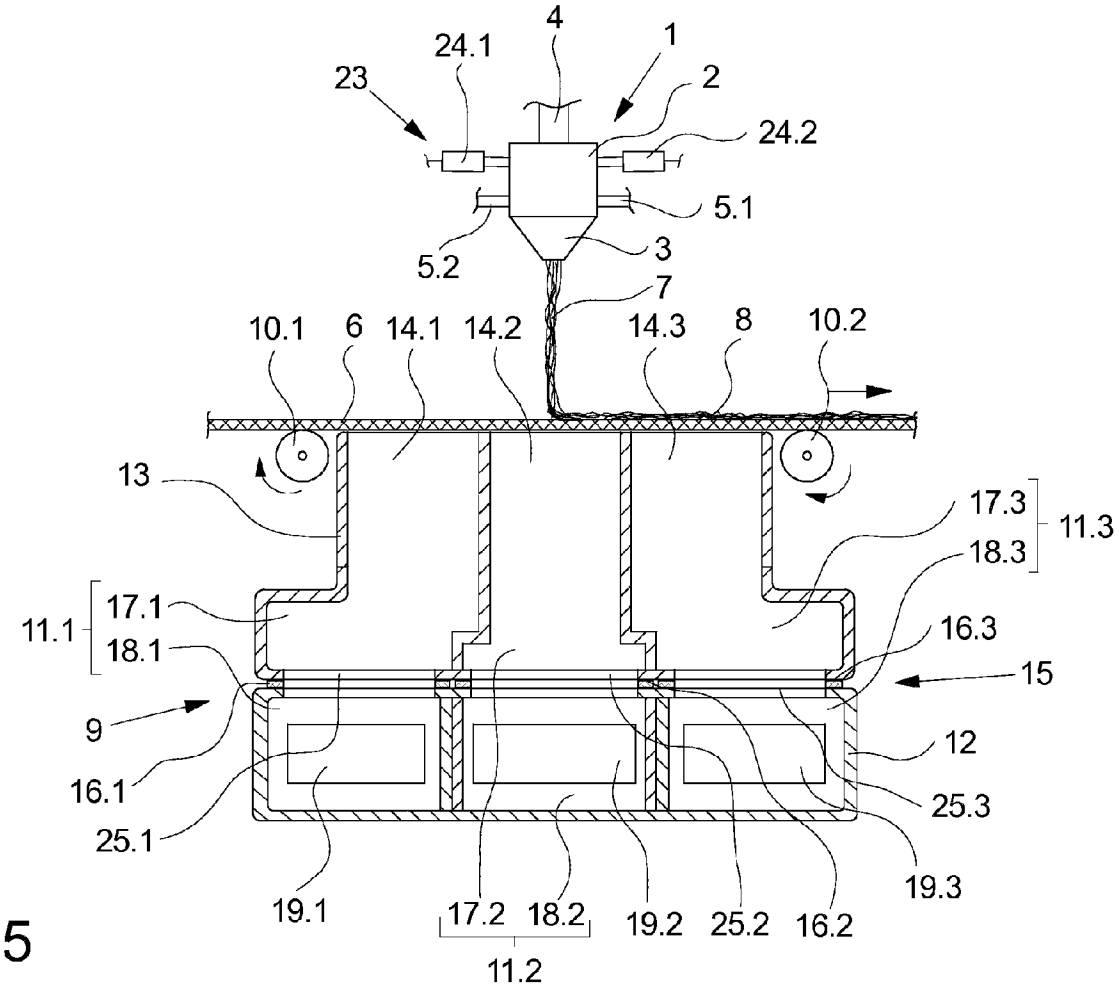

FIG. 5 schematically shows a longitudinal section of another embodiment of the device according to the invention.

Figure 6:
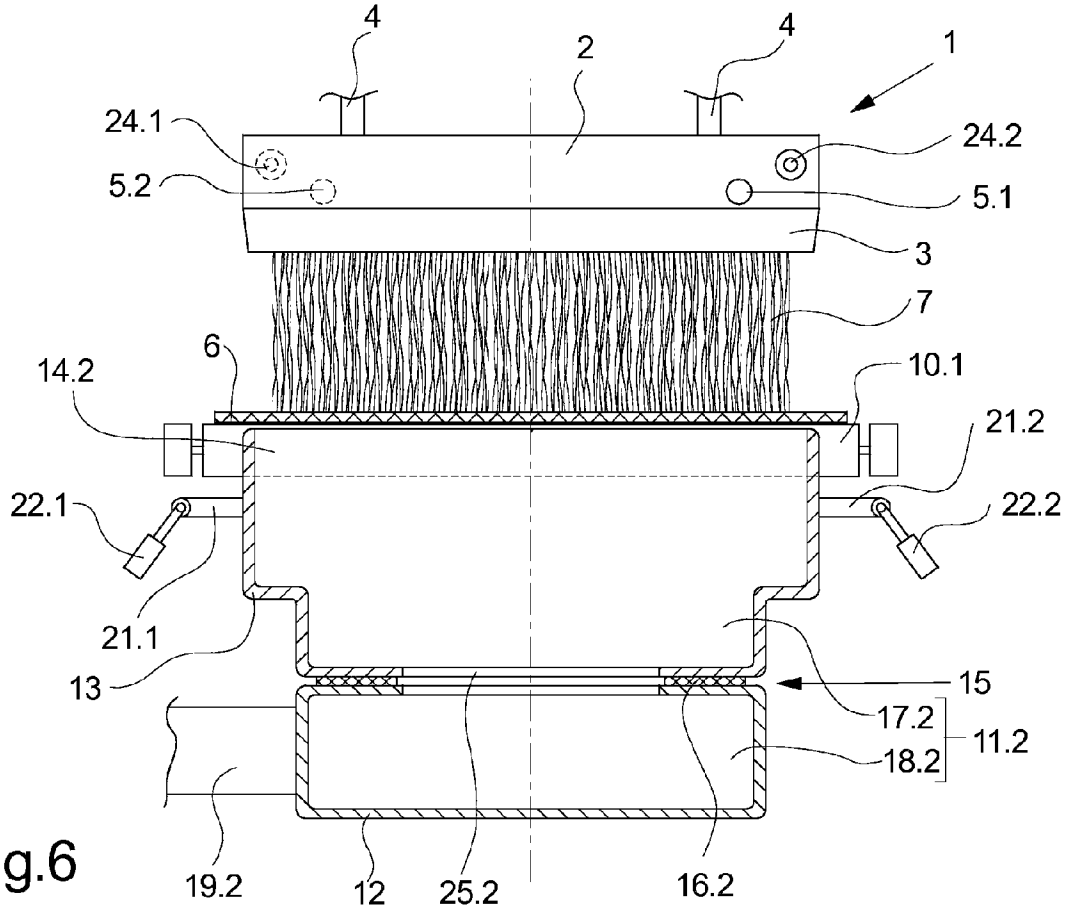

FIG. 6 schematically shows a cross-section view of the embodiment from FIG. 5.

Figure 7:
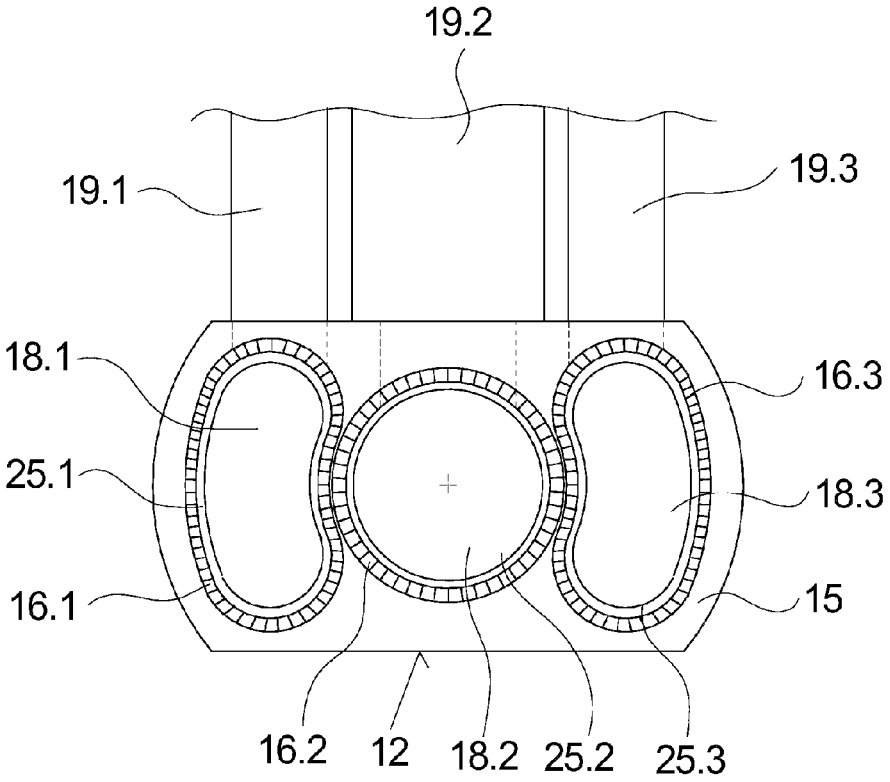

FIG. 7 schematically shows a top view of a lower box of the vacuum device according to the embodiment from FIG. 5.

A first embodiment is depicted schematically in FIGS. 1 and 2 from different perspectives. FIG. 1 shows the embodiment in a longitudinal sectional view, and FIG. 2 shows a top view. The following description applies to both figures, to the extent that no express reference is made to one of the figures.

The first embodiment of the device according to the invention for producing a fiber product by depositing melt-spun fibers includes a gas permeable delivery belt 6, which is guided over numerous belt rollers 10.1 and 10.2. Only a partial section of the delivery belt 6 is depicted, and the delivery belt is normally designed as a continuous belt guided over one or more driven belt rollers.

A spinning device 1 is provided on the upper surface of the delivery belt 6, which contains a spinning beam 2 disposed at a distance from the delivery belt 6. The spinning beam 2 has a nozzle device 3 on its undersurface, which includes, in this case, a spinneret for melt-blowing fibers, and two air nozzles disposed on both sides of the spinneret. Nozzle devices of this type are known in general, and described, by way of example, in EP 2 208 811 A1. To this extent, no further explanation shall be provided at this point, and reference is made to the cited document.

For the air supply, two separate air connections 5.1 and 5.2 are formed on the spinneret 2, and connected to the nozzle device 3.

The spinning beam 2 is mounted in a machine frame, not shown here, and can be pivoted parallel to the delivery belt 6 via a pivoting apparatus 23. The pivoting apparatus 23 is formed in this embodiment by two pivoting actuators 24.1 and 24.2, each of which engages with the ends of the spinning beam 2, and rotates the spinning beam 2 about a vertical central axis.

A vacuum device 9 is associated with the undersurface of the delivery belt 6. The vacuum device 9 includes a vacuum chamber 11, formed by a stationary lower box 12 and a mobile upper box 13. The upper box 13 is coupled to the lower box 12 in a pressure-sealed manner. For this, a sliding joint 15 is formed between the lower box 12 and the upper box 13, in which a seal 16 is disposed and encompasses a passageway 25 between the lower box 12 and the upper box 13 formed in the vacuum chamber 11. The lower box 12 thus contains a lower chamber section 18 of the vacuum chamber 11 and the upper box 13 contains an upper chamber section 17 of the vacuum chamber 11.

With the embodiment depicted in FIG. 1, the passageway 25 between the lower chamber section 18 and the upper chamber section 17 has a cross-section that is reduced in relation to the vacuum chamber 11. However, it is possible that the sliding surfaces on the lower box 12 and the upper box 13 necessary for forming the sliding joint 15 are displaced further outward, such that the vacuum chamber 11 includes a passageway 25 having the entire passageway cross-section.

The upper box 13 has a chamber opening 14 on its upper surface, which is directly associated with the undersurface of the delivery belt 6. The chamber opening 14 forms the connection between a deposit zone for the melt-spun fibers formed on the upper surface of the delivery belt 6 and the vacuum chamber 11. Thus, it is possible to generate a vacuum flow acting on the delivery belt 6.

The upper box 13 is disposed between the belt rollers 10.1 and 10.2, which, aside from guiding the delivery belt 6, form a seal on the undersurface of the delivery belt 6, such that no external air can be suctioned onto the undersurface of the delivery belt 6 via the vacuum chamber 11.

In order to move the upper box 13 in relation to the lower box 12, a lateral positioning arm 21 is disposed on the upper box and is engaged with by an adjustment actuator 22. By activating the adjustment actuator 22, the upper box 13 can be rotated about a central vertical axis in relation to the lower box 12. The passageway 25 is advantageously designed in the shape of a circle for this purpose, such that the vacuum power of the vacuum chamber 11 remains the same, independently of the position of the upper box 13.

The lower box 12 has a vacuum attachment channel 19, which is connected to a vacuum blower 20, as is shown schematically in FIG. 2.

In order to explain the function of the device according to the invention in accordance with the embodiment according to FIGS. 1 and 2, reference is also made to FIGS. 3 and 4. A top view of the vacuum device 9 beneath the delivery belt 6 is shown in various operating positions in FIGS. 3 and 4. FIG. 3 shows the vacuum device in the operating position, as is described in FIGS. 1 and 2. In FIG. 4, the vacuum device 9 is depicted wherein the upper box 13 is in a position rotated about a positioning angle in relation to the lower box 12.

To produce a fiber product, a polymer melt is supplied to the spinning beam 2 via the melt feed 4. The polymer melt is extruded under pressure via the nozzle device 3, and by means of an air flow, blown onto the delivery belt 6. This situation is depicted in FIG. 1. The fibers 7 are deposited onto the upper surface of the delivery belt 6 to form the fiber product 8 with the help of the vacuum flow generated by the vacuum device 9. Through continuous movement of the delivery belt in the conveyance direction, indicated by an arrow in FIGS. 1 and 2, the fiber product 8 is continuously transported from the deposit zone for the fibers 7. The fibers 7 are generated on a working width of the delivery belt 6, which is substantially determined by the position of the spinning beam 2 in relation to the delivery belt 6. In the situation depicted in FIGS. 1-3, the spinning beam 2 is substantially oriented orthogonal to the delivery belt 6. Accordingly, the chamber opening 14 on the upper surface of the upper box 13 also extends in a direction orthogonal to the delivery belt 6.

In order to produce a fiber product 8 having a reduced working width, the upper box 13 can be guided with the chamber opening 14 to a different angular position in relation to the lower box 12 and the delivery belt 6, such that the chamber opening 14 crosses the delivery belt 6 at an angle of <90°. An operating situation of this type is shown schematically in FIG. 4.

In order to deposit the fibers 7, the spinning beam 2 can be pivoted to a corresponding angular position via the pivoting device 23, such that a reduced working width is obtained on the upper surface of the delivery belt 6, and a fiber product 8 having a smaller width can be produced. The vacuum flow generated through the vacuum chamber 11 via the chamber opening 14 is identical in each of the desired operating positions, such that in each position of the spinning beam 2 and the vacuum device 9, a uniform deposit of the fibers is possible.

Another embodiment of the device according to the invention is shown in FIGS. 5 and 6. FIG. 5 depicts the embodiment in a longitudinal section view, and FIG. 6 depicts a cross-section view. Inasmuch as no express reference to one of the figures is made, the following description applies to both figures.

The embodiment depicted in FIGS. 5 and 6 is substantially identical to the aforementioned embodiment, such that the components having the same function are indicated with identical reference symbols, and such that only the differences shall be explained in the following.

With the embodiment depicted in FIGS. 5 and 6, the vacuum device 9 beneath the delivery belt 6 includes numerous vacuum chambers 11.1, 11.2, and 11.3. The vacuum chambers 11.1, 11.2, and 11.3 are formed in a lower box 12 and an upper box 13, lying parallel and adjacent to one another, in a direction transverse to the direction of conveyance of the delivery belt 6. On the upper surface of the upper box, a chamber opening 14.1, 14.2, and 14.3 is associated with each of the vacuum chambers 11.1-11.3. The chamber openings 14.1, 14.2, and 14.3 extend in a direction transverse to the delivery belt 6, and are associated with one of the deposit zones for receiving the fibers 7 provided on the upper surface of the delivery belt 6.

The upper chamber sections 17.1, 17.2, and 17.3 of the vacuum chambers 11.1, 11.2, and 11.3 are created within the upper box 13, and are separated from one another by a separating wall. The upper box 13 is formed by a cuboid shaped upper part and a rotationally symmetrical lower part, which is coupled in a pressure-tight manner to the lower box 12 via a sliding joint 15.

Numerous passageways 25.1, 25.2, and 25.3 are provided in the sliding joint 15 between the upper box 13 and the lower box 12, which connect a lower chamber section 18.1, 18.2, and 18.3 with the respective upper chamber section 17.1, 17.2, and 17.3 of the vacuum chambers 11.1, 11.2, 11.3. For sealing purposes, a seal 16.1, 16.2 and 16.3 is associated with each passageway 25.1, 25.1, 25.3.

A top view of the lower box 12 is shown in FIG. 7 to depict the design of the passageways 25.1, 25.2, 25.3 of the vacuum chambers 11.1, 11.2 11.3. Thus, the central vacuum chamber 11.2 has a circular passageway 25.2 between the lower box 12 and the upper box 13. The passageway 25.2 is encompassed by the seal 16.2 in the sliding joint 15. The outer vacuum chambers 11.1 and 11.3 each has kidney shaped passageways 25.1 and 25.3, which are designed as mirror images, reflected over the central passageway 25.2 in the lower box 12 and the upper box 13. The kidney shaped passageways 25.1 and 25.3 are encompassed in the sliding joint 15 by the seals 16.1 and 16.3. The passageways 25.1 and 25.3 are formed in different sizes, however, in the lower box 12 and the upper box 13, in order that no leakage occurs in the sliding joint 15 when the upper box 13 is rotated. Thus, the passageways 25.1 and 25.3 in the upper box 13 are smaller than the passageways in the lower box 12.

As can be seen from the depiction in FIG. 6, two adjustment actuators 22.1 and 22.2 are provided for adjusting the upper box 13 in relation to the lower box 12, which engage with two positioning arms 21.1 and 21.2, which are attached to the upper box 13 opposite one another. In this respect, the upper box 13 can be rotated about a vertical central axis in relation to the lower box 12.

The vacuum chambers 11.1, 11.2 and 11.3 are connected to separate vacuum attachment channels 19.1, 19.2, and 19.3 via the lower box 12. Each of the vacuum attachment channels 19.1, 19.2 and 19.3 are associated with separate vacuum blowers, not shown here, in order to adjust individual vacuums in each of the vacuum chambers 11.1, 11.2, and 11.3 for generating vacuum flows on the delivery belt 6. Thus, it is possible to generate a higher vacuum of, for example 200 mbar, in, for example, the central vacuum chamber, in order to enable a concentrated vacuum in the main deposit zone for the fibers. The lateral vacuum chambers 11.1 and 11.3 can be operated with a lower vacuum, in order to incorporate the ambient air on the upper surface of the delivery belt in the depositing process.

The embodiments of the device according to the invention depicted in FIGS. 1-6 are only shown by way of example. Generally, it is possible to design the vacuum device 9 such that the upper box 13 is displaced by linear movement in the direction of conveyance of the delivery belt. Likewise, it is possible that the spinning device includes a spinning beam having a spinneret that functions in conjunction with a downstream exhaust nozzle for generating a spunbond nonwoven. To this extent, the invention can also be applied to embodiments not shown here, having additional exhaust nozzles.

List of Reference Symbols

1 spinning device
2 spinning beam

3 nozzle device
4 melt feed
5.1, 5.2 air connection
6 delivery belt
7 fibers
8 fiber product
9 vacuum device
10.1, 10.2 belt rollers
11 vacuum chamber
11.1, 11.2, 11.3 vacuum chamber
12 lower box
13 upper box
14, 14.1, 14.2, 14.3 chamber opening
15 sliding joint
16, 16.1, 16.2, 16.3 seal
17, 17.1, 17.2, 17.3 upper chamber section
18, 18.1, 18.2, 18.3 lower chamber section
19, 19.1, 19.2, 19.3 vacuum attachment channel
20 vacuum blower
21 positioning arm
22 adjustment actuator
23 pivoting device
24.1, 24.2 pivoting actuator
25, 25.1, 25.2, 25.3 passageway

The invention claimed is:

1. A device for producing a fiber product by depositing melt-spun fibers on a delivery belt comprising:

a spinning device associated with an upper surface of the delivery belt; and, a vacuum device associated with a lower surface of the delivery belt to produce a vacuum flow, wherein the vacuum device includes a vacuum chamber that acts together with the spinning device to deposit the fibers on the delivery belt, the vacuum chamber including a stationary lower vacuum box connected to a vacuum attachment channel and a mobile upper vacuum box, which are coupled to one another in a pressure-tight manner to encompass a passageway therebetween, wherein the vacuum chamber defines a cross-section such that a substantial portion of the cross-section guides the vacuum flow wherein the upper vacuum box can be adjusted in relation to the lower vacuum box.

2. The device according to claim 1, further comprising a seal for sealing the vacuum chamber and being disposed in a sliding joint between the lower vacuum box and the upper vacuum box.

3. The device according to claim 2, further comprising a longitudinal chamber opening to the vacuum chamber formed in the upper vacuum box, the longitudinal chamber being oriented in a direction transverse to the delivery belt, wherein the position of the longitudinal chamber opening in relation to the delivery belt can be altered by rotating the upper vacuum box in relation to the lower vacuum box.

4. The device according to claim 3, wherein the upper vacuum box and the lower vacuum box include a plurality of vacuum chambers disposed successively in a direction of conveyance of the delivery belt, with each of the vacuum chambers being associated with a respective one of a plurality of seals between the upper vacuum box and the lower vacuum box.

5. The device according to claim 4, further comprising a plurality of vacuum attachment channels respectively associated with each of the vacuum chambers in the lower vacuum box, wherein each vacuum chamber in the lower vacuum box can be connected separately to one of a plurality of vacuum blowers.

6. The device according to claim 5, further comprising:

a central vacuum chamber that includes a circular transition cross-section in the sliding joint between the the upper vacuum box and the lower vacuum box, and two outer vacuum chambers next to the central vacuum chamber, each having a kidney shaped transition cross-section in the sliding joint between the the upper vacuum box and the lower vacuum box.

7. The device according to claim 4, further comprising a plurality of chamber openings opposite the delivery belt, each respectively associated with each of the vacuum chambers in the upper vacuum box, wherein the chamber openings are disposed parallel and adjacent to one another.

8. The device according to claim 4, further comprising:

a central vacuum chamber that includes a circular transition cross-section in the sliding joint between the the upper vacuum box and the lower vacuum box, and two outer vacuum chambers next to the central vacuum chamber, each having a kidney shaped transition cross-section in the sliding joint between the the upper vacuum box and the lower vacuum box.

9. The device according to claim 1, wherein the upper vacuum box and the lower vacuum box include a plurality of vacuum chambers disposed successively in a direction of conveyance of the delivery belt, with each of the vacuum chambers being associated with a respective one of a plurality of seals between the upper vacuum box and the lower vacuum box.

10. The device according to claim 9, further comprising a plurality of vacuum attachment channels respectively associated with each of the vacuum chambers in the lower vacuum box, wherein each vacuum chamber in the lower vacuum box can be connected separately to one of a plurality of vacuum blowers.

11. The device according to claim 9, further comprising a plurality of chamber openings opposite the delivery belt, each respectively associated with each of the vacuum chambers in the upper vacuum box, wherein the chamber openings are disposed parallel and adjacent to one another.

12. The device according to claim 1, wherein the upper vacuum box can be adjusted in an angular range of 45° in relation to the lower vacuum box.

13. The device according to claim 12 further comprising at least one adjustment actuator associated with the upper vacuum box wherein the upper vacuum box can be adjusted in relation to the lower vacuum box.

14. The device according to claim 1, wherein the spinning device includes a longitudinal spinning beam, which extends in a direction transverse to the delivery belt and is configured to rotate in a plane parallel to the delivery belt.

15. A device for producing a fiber product by depositing melt-spun fibers on a delivery belt comprising:

a spinning device associated with an upper surface of the delivery belt; and, a vacuum device associated with a lower surface of the delivery belt to produce a vacuum flow, wherein the vacuum device includes a vacuum chamber that acts together with the spinning device to deposit the fibers on the delivery belt, the vacuum chamber having a cross-section defined by (i) a lower vacuum box connected to a vacuum attachment channel and (ii) an upper vacuum box, wherein the lower vacuum box includes a passageway coupled in a pressure-tight manner to an upper vacuum box passageway such that a substantial portion of the cross-section guides the vacuum flow wherein the upper vacuum box can be adjusted in relation to the lower vacuum box.

16. The device according to claim 15 wherein the lower vacuum box is stationary and the upper vacuum box is mobile.

17. The device according to claim 16 wherein the lower vacuum box passageway and the upper vacuum box passageway are substantially the same size.

18. The device according to claim 17 wherein the lower vacuum box passageway and the upper vacuum box passageway extend the entire portion of the vacuum box cross-section.

* * * * *